United States Patent [19]

Emmendorfer

[11] 4,254,757

[45] Mar. 10, 1981

[54] FIREPLACE HEAT GENERATING SYSTEM

[76] Inventor: Charles Emmendorfer, 11215 N. Elms Rd., Clio, Mich. 48420

[21] Appl. No.: 60,178

[22] Filed: Jul. 24, 1979

Related U.S. Application Data

[63] Continuation-in-part of Ser. No. 837,508, Sep. 29, 1977, abandoned.

[51] Int. Cl.[3] ..... F24B 7/00

[52] U.S. Cl. ..... 126/121; 126/123; 126/131; 126/152 B

[58] Field of Search ..... 126/121, 120, 123, 131, 126/152 A, 165, 178, 164, 154, 140, 152 B, 163 R, 153, 181, 298

[56] References Cited

U.S. PATENT DOCUMENTS

| | | | |
|---|---|---|---|
| 1,434,083 | 10/1922 | Brander | 126/121 |
| 2,371,398 | 3/1945 | Lamar | 126/121 |
| 2,585,523 | 2/1952 | Wellman | 126/164 |
| 3,001,521 | 9/1961 | Reilly | 126/165 X |
| 3,866,595 | 2/1975 | Jones | 126/121 |
| 3,901,212 | 8/1975 | Stites | 126/165 X |
| 4,008,703 | 2/1977 | Allgood | 126/163 R |
| 4,019,492 | 4/1977 | Rush | 126/163 R X |
| 4,161,168 | 7/1979 | Cagle | 126/121 X |

*Primary Examiner*—James C. Yeung
*Assistant Examiner*—Larry Jones
*Attorney, Agent, or Firm*—Basile, Weintraub & Hanlon

[57] ABSTRACT

A fireplace heat generating system includes a plurality of conduits which cooperate to define a grate for seating logs or other combustible material there atop. The conduits are in communication with a heat deflector or shield at the base thereof. Discharge or heat issuing conduits or other suitable conveyances are disposed at the top of the shield and are in fluid communication with the shield. Intermediate discharge or heat issuing conduits are disposed between the upper discharge conduits and the grate conduits. The intermediate conduits are disposed in fluid communication with the deflector at one end thereof and are pivotal about the one end so as to be adapted to rest on and follow the top of the pile of combustible material seated on the grate downward as the combustible material is consumed. According to the present invention, cold air is transported through the device via the grate conduits whereat it is heated and transported through the deflector and exits out of the discharge conduits. A hollow container having an aperture therein in communication with an air duct is disposed within an ash dump in the fireplace. A retractable door is carried by the container for selectively blocking or opening the aperture in the container to prohibit or permit entry of air into the fireplace.

9 Claims, 9 Drawing Figures

FIREPLACE HEAT GENERATING SYSTEM

CROSS REFERENCE TO CO-PENDING APPLICATION

This application is a continuation-in-part of a co-pending application, Ser. No. 837,508 filed Sept. 29, 1977 in the name of Charles V. Emmendorfer, now abandoned.

BACKGROUND OF THE INVENTION

1. Field of the Invention

The present invention pertains to heat generating systems. More particularly, the present invention pertains to fireplace associated heat generating systems.

2. Description of the Prior Art

The prior art has disclosed and taught two generating systems which are fireplace associated. Such prior art systems include a grate structure for seating combustible materials there atop, such as logs and other materials. Generally, such systems include means for conveying cold air through the grate structure and then issuing it back into the environment through a conduit system which is disposed about the grate structure. Ordinarily, the grate structure and the delivering conduit system are in fluid communication. In this manner, air travels through the assembly wherein it is heated at the grate site and delivered back to the environment through the delivering system.

It is to be appreciated from a review of the prior art that such prior art systems rely solely upon the heat transfer from the combustible material through the assembly and to the air for generating heat. Ordinarily, the capturing and reflectance of the radiant heat generated by the combustible material is lost and/or totally neglected by the prior art devices. This over sight results in a tremendous loss of the heat values associated with the combustible materials which are ordinarily ignited and burned in a fireplace.

Because of the presently acknowledged energy shortage attendant the use of petroleum-type fuels, it is to be appreciated that the public is being forced to look at alternate heat sources such as the fireplace heat generating systems of the type under consideration herein. Because of the hereinabove noted loss of the radiant energy associated with the combustible materials, ordinarily, the true heat values generated by such heating systems are lost. Furthermore, it is to be appreciated that if these heat values could be captured and retained then an enhanced valuable alternate heat generating system is provided.

It will be appreciated that the present invention, as will be subsequently be described, provides a mode whereby the radiant heat values are captured and retained.

SUMMARY OF THE INVENTION

In accordance with the present invention, there is provided a fireplace heat generating system or furnace which comprises a plurality of conduits which are substantially parallel, spaced apart and co-extensive. The conduits have sufficient structural rigidity to have combustible material, such as logs or the like, seated there atop. Each of the conduits is in communication with a source of cold air at one end thereof. The other end of each conduit is in fluid communication with a deflector shield. The shield is a generally upstanding or vertically extending member having the conduits defining the grate in fluid communication therewith at the base thereof. The cold air captured by the grate system is delivered to the deflector in which it travels upward and exits through the heat delivery means.

The heat delivery means generally comprises a pair of spaced apart, parallel, first conduits which are substantially parallel to the grate conduits. The first conduits have a first end disposed in fluid communication with the deflector and a second end in communication with the atmosphere within the room containing the fireplace.

The heat delivery means further comprises a plurality of adjacent, co-planar, second conduits. The second conduits are pivotal about a first end, which is located approximately intermediate between the first conduits of the heat delivery means and the grate conduits, and are disposed in fluid communication with the deflector at the first end. The second conduits are adapted to rest on and to follow the top of the pile of combustible material seated on the grate conduits downward as the combustible material is consumed. According to the present invention, the cold air delivered through the grate conduits is heated by the combustion of materials as well as by the heat transfer through the heat generating system hereof. The cold air travels through the deflector and is delivered back to the room atmosphere through the heat delivery means.

Furthermore, and in accordance with the present invention, the heat generating system hereof further comprises means for forcing the circulation of air through the assembly hereof. In addition, the present invention contemplates means for damping the heated air being delivered through the heat as well as means for connecting the present heat generating means to a forced air furnace or the like. The present invention also contemplates means for delivering cold air to the grate conduits through a common source.

In addition, the present invention provides a combination ash dump/cold air intake vent assembly. The vent assembly which is situated beneath the heat generating system in the floor of the fireplace recess, includes a hollow container located in the ash dump. The container includes an aperture in alignment with the cold air duct. A door, slideably carried by the container, is retractable between a closed position, wherein the aperture to the cold air duct is sealed, and an open position in which air from the cold air duct enters the container and flows into the fireplace.

For a complete understanding of the present invention, reference is made to the following detailed description and accompanying drawing. In the drawing, like reference characters, refer to like parts throughout the several views in which:

DESCRIPTION OF THE PREFERRED EMBODIMENTS

Figure 1:
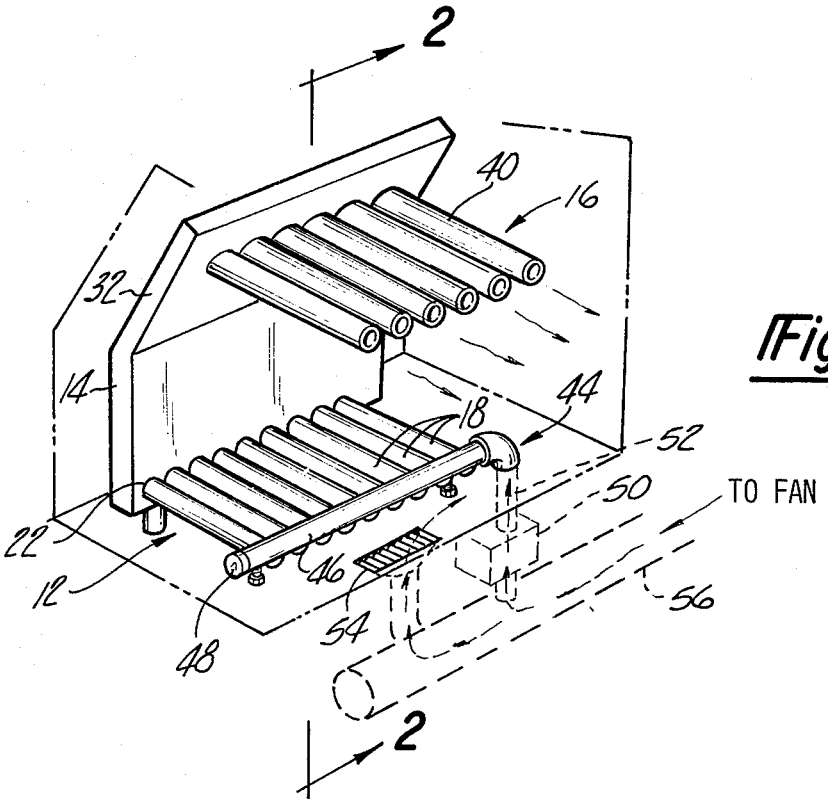
FIG. 1 is a perspective view, partly in phantom, of the heat generating system constructed according to one embodiment of the present invention.

Now, and with reference to the drawing, there is depicted therein a heat generating system in accordance with one embodiment of the present invention generally denoted at 10. The heat generating system 10 hereof, generally comprises a grate 12, a deflector or shield 14 and means for delivering heated air 16. In accordance with the present invention, the deflector 14 is a unitary member which presents a substantially solid surface to avoid and obviate dissipation of the radiant energies generated by the combustion of materials. The solid surface, thus, reflects into the environment the radiant energy as well as retaining same by virtue of its materials of construction.

It should be further noted with respect hereto that the solid surface defined by the deflector, also defines means for preventing fireplace masonry burn-out. Heretofore known transportable units have not obviated the burn-out problem. As is known to the skilled artisan, the operation of a fireplace is occasioned with charring or burn-out of the masonry used to erect the fireplace. As noted, the present invention obviates this problem.

With more particularity, the grate assembly comprises at least one conduit 18. The conduit 18 is formed from a material of construction having sufficient strength to support a plurality of fireplace logs 20 or other combustible material thereon. Furthermore, the conduit is, preferably, formed from a material having a substantial heat transfer co-efficient such that the heat generated by the combustion of the combustible material is readily transferred through the conduit to a fluid medium, such as air, in a manner to be described hereinafter. Thus, the conduit is formed from wrought iron or similar material.

In a preferred mode of practicing the invention, the grate or grate assembly 12 comprises a plurality of conduits 18. The conduits 18 are substantially parallel to each other and co-extensive. The conduits project laterally outwardly from the deflector or shield 14, as shown. The interior of the conduit is in fluid communication with the interior of the shield 14. Thus, a first end 22 of the conduit opens into fluid communication with the interior of the shield 14 and is, thus, connected thereto. Any suitable mode of effectuating connection between the shield and the conduit can be utilized herein. Preferably, however, the conduit is threadably connected to the deflector to enable detachable connection therebetween. Thus, a conduit can be replaced upon the necessity therefor. The conduit is connected to the deflector or shield proximate the base 24 thereof.

The shield, per se, comprises a solid surfaced member including a front wall 26, a rear wall 28, a base 24 and a top wall 30. A pair of opposed opposite side walls 32 (only one of which is shown) enclose the structure defining the deflector. As noted, the deflector has a hollow interior space of volume 34 which provides and enables a fluid flow therethrough. Because of the conventional structure accorded most hearths, the deflector comprises first and second sections. The deflector includes a first upstanding section generally denoted at 36 and a second section 38 which is angularly inclined with respect to the section 36, as shown. Such a configuration comports the outline of the deflector to that of a conventional hearth. However, it is to be understood that this angular inclination of one section with respect to the other is shown as illustrative, only. The present invention is not to be construed as being limited to such a configuration. Rather, any configuration can be utilized with equal efficacy herein. Furthermore, it should be known that the deflector is formed as an integral or unitary member.

The means for issuing heat generated is utilized to deliver heated air from the interior space 34 to the atmosphere surrounding the present heating system. The means 16 generally comprises a conduit 40 having one end thereof in fluid communication with the interior space 34 of the deflector 14. The opposite or other end of the conduit opens to the atmosphere. Optimally, the conduit 40 projects laterally outwardly from the deflector and is detachably connected thereto such as by threaded connection or the like. The conduit 40 is disposed substantially parallel to the conduit 18 and is vertically axially spaced apart therefrom.

In practicing the present invention, the grate 12 comprises a plurality of conduits 18 which are adjacent to each other, co-extensive and each is in fluid communication with the interior of the deflector. The means 16, also, comprises a plurality of conduits 40 which are adjacent to each other, co-extensive and analogous. In practicing the present invention, cold air is circulated through the conduit 18, upwardly through the interior space 34 whereat it is heated by the combustion of the material or logs 20 and the so-heated air is then issued to the atmosphere by its flow through the conduit 40. This is clearly shown by the arrows 44 in FIG. 1.

Figure 2:
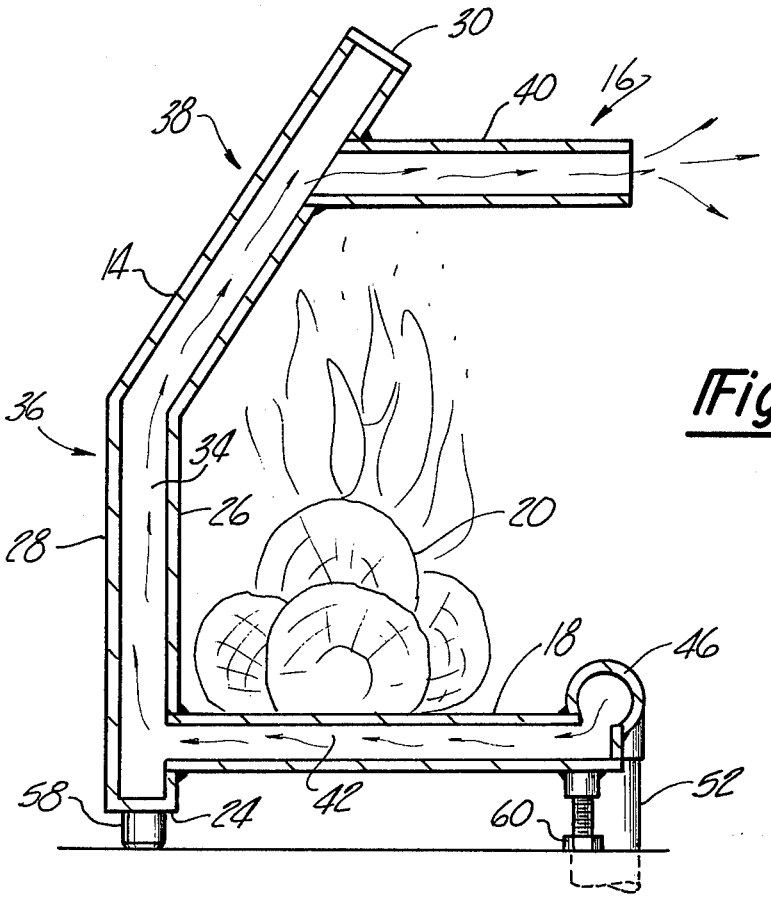
FIG. 2 is a cross sectional view taken along line 2—2 of FIG. 1.

The air to be heated in accordance herewith, is supplied, in a first embodiment of the present invention, as shown in FIGS. 1 and 2, via a cold air supply means, generally denoted at 44. The cold air generating supply means comprises a conduit or the like which traverses the free or outer ends of the conduits 18 and is in fluid communication therewith. The means 44 generally comprises a conduit 46, the interior of which opens into fluid communication with at least one of the conduits 18. One end of the conduit 46 is sealed via a cap 48 or the like. The opposite end of the conduit is open to the atmosphere to capture cold air to flow therethrough. In a preferred mode of practicing the invention, a fan 50 or the like is connected to a conduit 52 which, in turn, is connected to the conduit 46 at its free or open end. The fan 50, when operable, draws cold air from the atmosphere through the conduit 52 and delivers same into the conduit 46 for delivery into the grate 12. Furthermore, the fan forces the flow of air through the space 34 as well as through the means 16. The conduit 52 can be vented to the atmosphere or to any suitable source of cold air. Generally, and as is known to the skilled artisan, most hearths include a fireplace vent 54 which is vented to the outside or exterior of the dwelling via a conduit 56. Herein, the conduit 52, which can be integrally formed with the conduit 46 to define a unitary member can be tapped into the cold air return duct or conduit 56, if desired.

In constructing the heat generating system 10 hereof, legs 58 (only one of which is shown) can be secured to the base 24 of the deflector to provide standing support thereof. Also, variably adjustable legs 60 can be secured to the grate assembly to enable the height of the grate to be adjusted and to render the assembly level. Furthermore, the issuing means 16 can comprise conduits of different lengths or a single conduit.

It will be appreciated from the preceding that the present invention enables maximum utilization of the heat generated by the combusting materials or logs 20 without the loss of heat which is ordinarily occasioned in a fireplace or the like.

Figure 3:
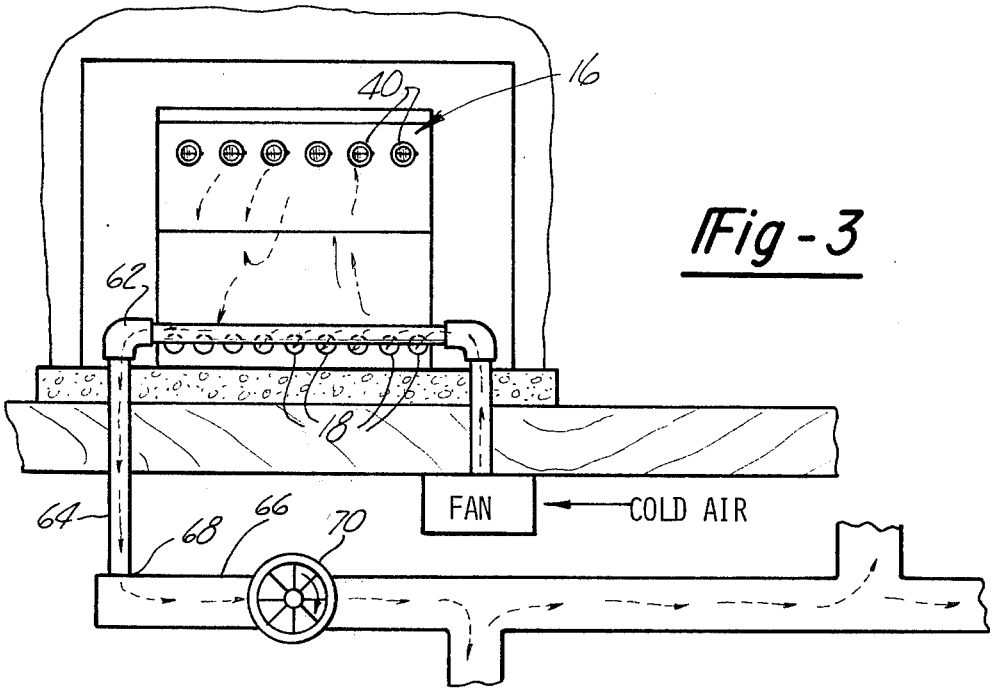
FIG. 3 is a side elevational view of an alternate embodiment of the present invention depicting the transference of generated heat from a fireplace to other sections of a dwelling.
Figure 4:
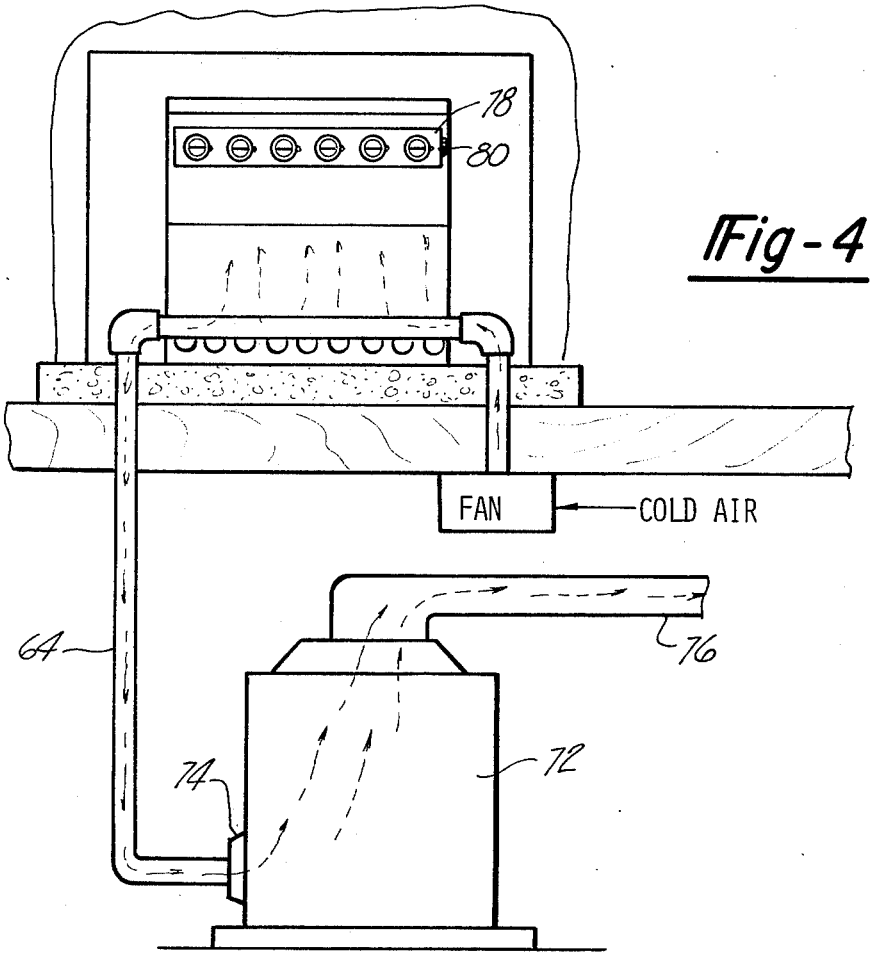
FIG. 4 is a side elevational view depicting the interconnection between the present heat generating system and a forced air furnace.

In FIGS. 3 and 4, there is shown a further modification of the present invention.

In accordance herewith, the end cap 48 is eliminated and an elbow 62 is threadably connected to the conduit 46. A conduit 64 depends from and is threadably connected to the elbow 62. The interior of the conduit 64 is, thus, in fluid communication with the conduit 46. The opposite or free end of the conduit 64 is connected to a duct 66. The conduit 64 is connected to the duct 66 via a suitable opening 68 or the like. In this manner, the interior of the conduit 64 is in fluid communication with the interior of the duct 66. It is to be thusly seen that the excess fluid or air traveling through the conduit 46 is then transferred into the duct system of the dwelling. It is to be further appreciated that by virtue of the amounts of heat generated by the combustion of the logs that the air travelling through the duct 46 is, itself, heated. Thus, this heated air is utilized to assist in the heating of other rooms within a dwelling via the duct 66. A fan 70 is utilized to control the air flow through the duct 66 in the well-known manner.

In FIG. 4 hereof, there is shown a further deployment in utilization of the present heating system. Herein, the conduit 64 is connected to a forced air furnace 72 at the cold air return 74 thereof. From the cold air return entrance, the fluid which is usually air entrained within the conduit 64 is heated within the furnace and then issued back into the dwelling via the duct work 76. In this instance, the heat generating system is utilized to preheat the air returning to the furnace via the cold air return. This minimizes the amount of energy required to heat the air within the furnace, thus, providing a further substantial energy utilization reduction.

Furthermore, and in accordance with the present invention, and as shown in FIGS. 3 and 4, in lieu of the direct connection between the conduits 40 and the deflector 14, a hollow housing 78 is interposed between the deflector and each of the conduits. The conduits are mounted to the housing which, in turn, is mounted to the deflector and is in fluid communication therewith. Thus, there is fluid communication between the conduits and housing. A baffle plate (not shown) is rotatably mounted within the housing. An exterior handle 80 is connected to the baffle plate to regulate the amount of heat issuing into the housing 78. Thus, the baffle plate defines a damper for controlling the amount of heat issuing into the atmosphere via the means 16.

It is to be further appreciated by the practice of the present invention that each of the conduits could utilize their own damper or baffle plate and could be individually mounted thereto. Furthermore, baffles or the like could be incorporated to the deflector to, again, control the amount of air flowing upwardly within the interior space 34.

Figure 5:
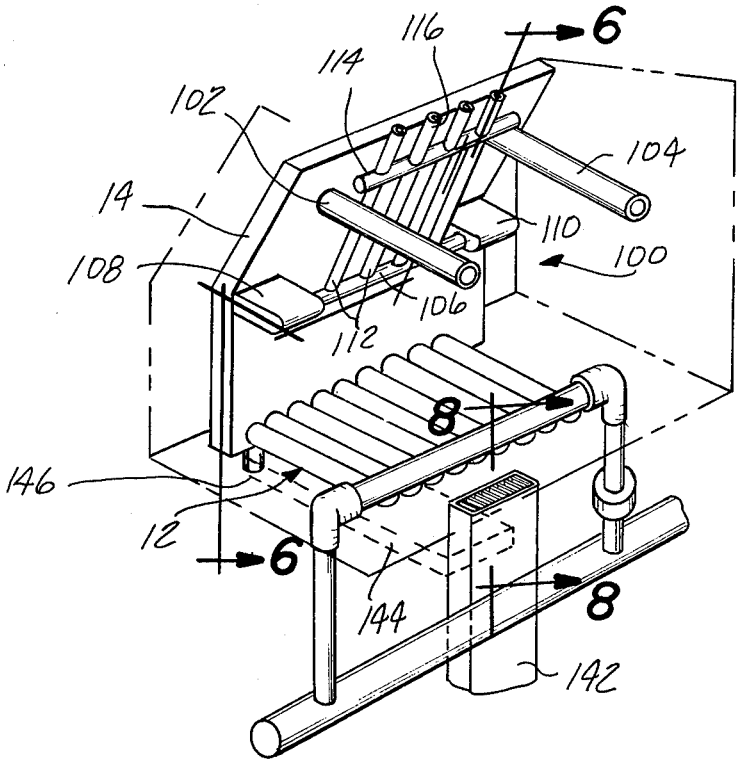
FIG. 5 is a perspective view, partly in phantom, of a heat generating system constructed according to another embodiment of the present invention.
Figure 6:
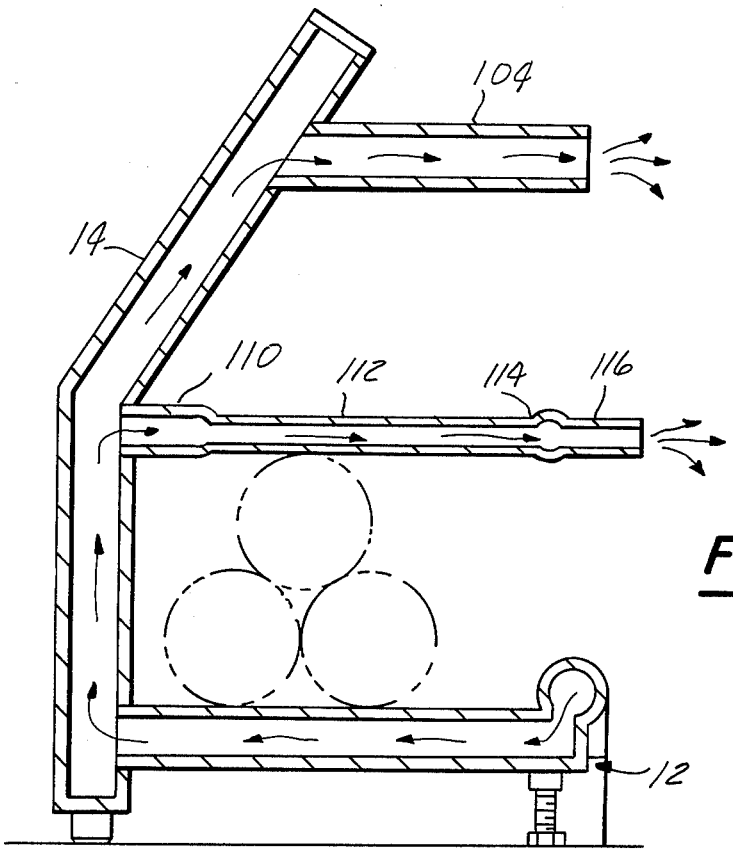
FIG. 6 is a cross sectional view, generally taken along line 6—6 in FIG. 5.

Referring now to FIGS. 5 and 6, there is shown another embodiment of the heat generating system of this invention. As shown therein, the means for issuing air into the room are modified to include a second or intermediate air discharge means, indicated generally by reference number 100. In accordance with this embodiment, the upper or top conduits of the air issuing means are modified, from that shown in FIGS. 1 and 2 and described earlier, to include a pair of spaced, co-extensive, coplanar conduits 102 and 104. The pair of first conduits 102 and 104 are connected at a first end thereof to the top of the deflector 14 such that the interior of the conduits 102 and 104 are disposed in fluid communication with the interior of the shield 14. The second end of the conduits 102 and 104 may extend into the room occupied by the fireplace or they may be ducted to another room or to a heating furnace duct.

The intermediate air issuing means 100 includes a manifold 106, which extends across the width of the deflector 14 and is located approximately in the middle of the vertical height of the deflector 14. The ends of the manifold 106 are disposed within end pieces 108 and 110 so as to be rotatable therein. The end pieces 108 and 110 are secured to the deflector 14 by suitable means, such as through welds, or they may be bolted to the deflector 14 so as to be removable therefrom. The manifold 106, as well as the end pieces 108 and 110, are hollow and are disposed in fluid communication with the interior of the deflector 14 such that the heated air flowing through the interior of the deflector 14 flows through the end pieces 108 and 110 and the manifold 106.

This intermediate air issuing means 100 further includes at least one, and preferably a plurality of conduits 112. The conduits 112 have a first end secured to the manifold 106 such that the interior of the conduits 112 are disposed in fluid communication with the interior of the manifold 106. The second ends of the conduits 112 are secured to an upper header or manifold 114 which, likewise, is disposed in fluid communication with the interior of the conduits 112. A plurality of upper conduits 116 are affixed to the upper header 114 and are disposed in fluid communication with the interior thereof, so as to issue heated air from the interior of the conduits 112 and 116 into the room. It is also feasible to extend the second conduit 112 directly into the room without the upper header 114 and upper conduit 116. The manifold 106, conduits 112, upper header 114 and upper conduits 116 are secured in a unitary assembly which is pivotal about a longitudinal centerline extending through the center of the manifold 106 between the end pieces 108 and 110. In this manner, the intermediate air issuing means 100 may be pivoted until the intermediate air issuing means 100 is situated adjacent to the top portion of the deflector 114. Although not shown, a suitable latch means may be provided to securely hold the intermediate air discharge means 100 in the aforementioned upward position. With the intermediate air discharge means 100 in the upward position, the combustible material, such as logs, may be disposed in a pile on top of the conduits 18 forming the grate structure 12 of this invention. The intermediate discharge means 100 may then be lowered until it is in registry with the top of the pile of combustible material. Thus, the intermediate air discharge means 100 is free to pivot about the manifold 106 between the end pieces 108 and 110 and to thereby follow the top of the pile of combustible material downward as the combustible material is consumed.

In this manner, additional quantities of the radiant heat generated by the combustible material are captured by the intermediate air discharge means 100 since the air discharge means 100 is in direct contact with the pile of combustible material. This results in the air issuing therefrom into the room being heated to a greater extent then with the embodiment shown in FIGS. 1 and 2 and described above. The remainder of the heat generating system functions identically to that described above with reference to FIGS. 1 and 2 in so far as heating the air which is input to the grate structure and issuing the heated air into the room in which the fireplace is located.

Figure 7:
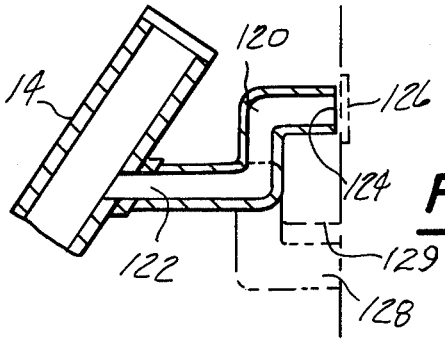
FIG. 7 is a partial cross sectional view of a portion of the heat generating system as shown in FIG. 5 modified in accordance with another embodiment of this invention.

Referring now to FIG. 7, there is shown a modified version of the upper or first conduits 102 and 104, shown in FIG. 5. According to this version, the first or upper conduit 120 is formed such that the first and second ends 122 and 124 are disposed at different, spaced vertical heights. In addition, the conduit 120 is mounted for rotational movement about the first end 122 in the deflector 14.

Thus, the first conduit 120 may be rotated to a first position in which the second end 124 of the conduit 120 is disposed in fluid communication with a vent 126 located within the wall forming the top of the fireplace recess so as to issue the heated air into the room. Alternately, the conduit 120 may be rotated to a second position 128 in which the second end 124 is located beneath the lower edge of the top of the fireplace opening 129. In this manner, the heat generating system of this invention may be installed in new fireplaces or may be retrofit into existing fireplaces without the need for forming additional vents in the existing brickwork normally surrounding a fireplace opening.

Figure 8:
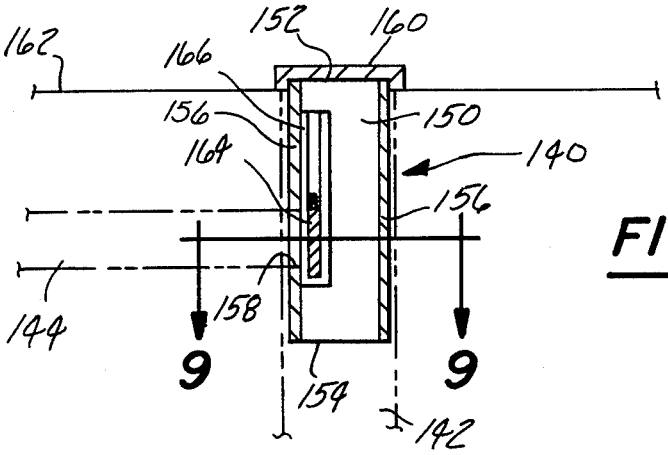
FIG. 8 is a cross sectional view, generally taken along line 8—8 in FIG. 5 showing another embodiment of this invention.
Figure 9:
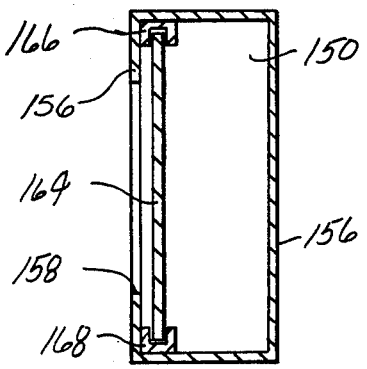
FIG. 9 is a cross sectional view, generally taken along line 9—9 in FIG. 8.

Referring now to FIGS. 5, 8 and 9, there is shown another embodiment of this invention. As shown therein, a combination ash dump/cold air intake vent assembly shown generally by reference number 140 is depicted. The ash dump/cold air intake vent assembly 140 is disposed within a conventional ash dump 142 which is formed in the floor beneath the fireplace opening to provide a means for disposing of the residue of the combustible material. Such residue is typically swept down the ash dump into a trap in the basement of the house and removed at a later time.

According to this embodiment of this invention, a suitable cold air intake duct 144 is formed within the fireplace structure. The cold air duct 144 includes a first end 146 which is disposed in communication with a source of cold air and a second end which intersects and is disposed in fluid communication with the ash dump 142 such that a flow of cold air may be provided through the cold air duct 144 and the ash dump 142 to the fireplace thereby maintaining an adequate draft to consume the combustible materials that are disposed therein.

It should be noted that when an ash dump/cold air intake assembly 140 can be utilized in a fireplace assembly in conjunction with the fan 50, cold air conduit 52 or cold air return duct 56 described above or it may be utilized by itself to supply cold air to the fireplace when the other cold air structure is undesirable or unfeasible.

As shown in FIG. 5 and in greater detail in FIGS. 8 and 9, the combination ash dump/cold air intake vent assembly 140 comprises a hollow, box-like container 150. The container 150 has first and second opposed open ends 152 and 154, respectively, which provide a opening completely through the container 150 into the ash dump 142. The container 150 further includes side wall portions 156, one of which contains a suitably formed aperture 158 which disposes the interior of the container 150 in fluid communication with the cold air intake duct 144.

The container 150 is secured within the ash dump 142 by suitable means, such as by forming a lip adjacent the upper end 152 of the container 150, not shown, which seats upon the floor 162 of the fireplace opening, as shown in FIG. 8. In addition, a conventially formed louvered vent 160 may be disposed over the open end 152 of the container 150 to provide a cover for the combination ash dump/cold air intake vent assembly 140 of this invention.

The container 150 carries a suitably dimensioned panel 164 which is retractable between first and second positions. The panel 164 is slideably supported within side edge guides 166 and 168 which are fixed to the interior side walls 156 of the container 150. The panel 164 is slidable between a first position in which the panel 164 completely blocks or seals the air intake duct 144 from the ash dump 142. In this manner, ashes may be dumped through the container 150 into the ash dump 142 without air flowing from the cold air intake duct 144 into the fireplace to disrupt the disposal operation. In addition, the panel 164 sealingly blocks the cold air intake duct 144 thereby prohibiting the entry of air into the interior of the house when the fireplace is not in use.

The panel 164 is slidingly retractable to a second, open position in which the aperture 158 in the side wall 156 of the container 150 is open thereby disposing the interior of the cold air intake duct 144 in fluid communication with the interior of the ash dump duct 142. This permits cold air to flow into the fireplace and feed the combustion of the combustible material disposed therein. Although not shown, the panel 164 may be retractable between first and second positions within the container 150 and secured in the second, open position by a suitably formed latch means, not shown. The panel 164 can also be completely removed from the container 150 by initially removing the louvered vent 160 and sliding the panel 164 out of the side edge guides 166 and 168 in the container 150.

It should be noted that the combination ash dump/cold air vent assembly 140 of this invention is adaptable to several different types of installations. For one, the cold air intake duct 144 may be formed between the exterior of the house and the ash dump. In this installation the first end 146 of the cold air duct is in communication with the exterior atmosphere, such that cold air from the external atmosphere flows into the fireplace thereby eliminating the use of heated interior air to feed the combustion of the combustible material. Alternately, the container 150 may be rotated 180° within the ash dump 142 such that a cold air intake duct connected to a source of outside air may be connected in fluid communication with the ash dump 142 to feed cooler air into the fireplace. Regardless of which configuration is utilized, a significant reduction in home heating costs is realized since previously heated air from the furnace system within the house is not utilized to form the draft required to maintain combustion of the materials within the fireplace.

It is to be understood, however, that all such modifications are within the purview of the present invention.

However, the accessories hereinabove defined are utilized as a means for further deploying the excess heat generated by the system hereof.

It is to be appreciated from the preceding that there has been described herein a heat generating system for heating the environment and which further utilizes the excess heat generated thereby to heat further parts of the environment. Furthermore, the present invention utilized and deploys a solid deflector plate which prevents the dissipation of heat generated by the combustion of the logs or the like.

It will be apparent from the preceding that other modifications and changes in the present invention can be made herein. Such modifications are within the spirit and scope hereof.

What is claimed is:

1. A heat generating unit adapted to be disposed in a fireplace recess comprising:

a fireplace grate for supporting combustible material thereon, said fireplace grate comprising a plurality of adjacent, co-extensive, co-planar conduits;

an upstanding deflector shield comprising a hollow unitary member, the interior of said grate conduits being disposed in fluid communication with the interior of said deflector shield;

means for issuing heated fluid from said interior of said deflector shield into the atmosphere, said issuing means comprising:

at least one first conduit disposed above said grate conduits in fluid communication with said interior of said deflector shield;

at least one second conduit having a first end disposed intermediate between said grate conduits and said first conduit, said first end of said second conduit being disposed in fluid communication with said interior of said deflector shield and being pivotal about said first end connected to said deflector shield such that said second conduit is adapted to rest upon and to follow the top of the pile of combustible material supported on said grate conduits downward as said combustible material is consummed; and wherein a fluid to be heated travels from said grate conduits upwardly through said deflector shield and issues through said issuing means, said fluid being heated upon combustion of the material.

2. The heat generating unit of claim 1 wherein the issuing means comprises a pair of spaced, co-planar first conduits, each being disposed in fluid communication with the interior of the deflector shield and parallel to the grate conduits.

3. The heat generating unit of claim 1 wherein the issuing means comprises;

a manifold disposed intermediate between the grate conduits and the first conduit of said issuing means, said manifold having first and second ends and being rotatable about a longitudinal axis extending therethrough between said first and second ends, said first and second ends of said manifold being connected to the deflector shield to dispose the interior of said manifold in fluid communication with the interior of the deflector shield; and a plurality of adjacent, co-extensive, co-planar, second conduits, each having one end disposed in fluid communication with said manifold.

4. The heat generating unit of claim 1 further including a second manifold disposed in fluid communication with the grate conduits for distributing the fluid to said grate conduits.

5. The heat generating unit of claim 1 wherein:

the first conduit of the issuing means includes first and second ends, said first end disposed in fluid communication with the deflector shield, said second end being vertically spaced from said first end; and said first conduit being rotatable about said first end such that said second end of said first conduit may be rotated between upper and lower positions with respect to said first end.

6. The heat generating unit of claim 1 wherein the fireplace recess includes an ash duct located proximate the grate structure and an air duct disposed in fluid communication between a source of cold air on one end and said ash duct on the other end to provide cold air to the fireplace, said heat generating unit further including:

a hollow container having side walls and open ends adapted to be disposed within said ash duct, one of said side walls having an aperture therein to dispose the interior of said container in fluid communication with said air duct; and a retractable panel slidably carried within said container and movable between a first position wherein said panel blocks the flow of air from said air duct into said container and a second position wherein said aperture in said container is open so as to allow cold air to flow from said air duct through said container into said fireplace.

7. The heat generating unit of claim 6 wherein the air duct is disposed in fluid communication with the exterior atmosphere on one end.

8. The heat generating unit of claim 6 wherein the air duct is disposed in fluid communication with an external source of air.

9. A heat generating unit adapted to be disposed in a fireplace recess comprising:

a fireplace grate for supporting combustible material therein, said fireplace grate comprising a plurality of adjacent co-extensive, co-planar conduits;

an upstanding deflector shield comprising a hollow unitary member, the interior of said grate conduits being disposed in fluid communication with the interior of said deflector shield;

means for issuing heated fluid from the interior of said deflector shield to the room, said issuing means comprising:

a pair of spaced, co-planar, first conduits disposed adjacent the top of said deflector shield, each of said first conduits being disposed in fluid communication with the interior of said deflector shield, said first conduits being substantially parallel to said grate conduits;

a manifold disposed intermediate between said grate conduits and said first conduits of said issuing means, said manifold having first and second ends and being rotatable about a longitudinal axis extending therethrough between said first and second ends, said first and second ends of said manifold being connected to said deflector shield to dispose the interior of said manifold in fluid communication with the interior of said deflector shield, said manifold extending across the width of said deflector shield;

a plurality of adjacent, co-extensive, co-planar, second conduits each having a first end connected to said manifold so as to dispose the interior of said second conduits in fluid communication with the interior of said manifold, said second conduits being pivotal about said first end connected to said manifold such that said second conduits are adapted to rest upon and to follow the top of the pile of combustible material supported on said grate conduits downward as said combustible material is consummed;

wherein a fluid to be heated travels from said grate conduits upwardly through said deflector shield and issues through said issuing means, said fluid being heated upon combustion of said combustible material; and a second manifold disposed in fluid communication with said grate conduits for distributing said fluid to said grate conduits.

* * * * *